US006387215B1

(12) United States Patent
Spence et al.

(10) Patent No.: US 6,387,215 B1
(45) Date of Patent: May 14, 2002

(54) USE OF ACRYLAMIDE COPOLYMER TO REDUCE STICKIES DEPOSITS

(75) Inventors: Gavin G. Spence; Alan J. Schellhamer, both of Columbus; Stephen R. Kurowsky, Pine Mountain, all of GA (US)

(73) Assignee: Callaway Chemical Corporation, Columbus, OH (US)

( * ) Notice: Subject to any disclaimer, the term of this patent is extended or adjusted under 35 U.S.C. 154(b) by 0 days.

(21) Appl. No.: 09/860,754

(22) Filed: May 18, 2001

Related U.S. Application Data

(60) Provisional application No. 60/205,283, filed on May 18, 2000.

(51) Int. Cl.[7] ..... D21C 9/08
(52) U.S. Cl. ..... 162/199; 162/168.3; 162/DIG. 4
(58) Field of Search ..... 162/48, 168.3, 162/199, 1.58, DIG. 4

(56) References Cited

U.S. PATENT DOCUMENTS

| | | | | | |
|---|---|---|---|---|---|
| 3,992,249 | A | * | 11/1976 | Farley | 162/72 |
| 5,395,868 | A | * | 3/1995 | Sanduja et al. | 524/104 |
| 5,474,655 | A | * | 12/1995 | Schulte et al. | 162/175 |
| 5,723,021 | A | * | 3/1998 | Nguyen | 162/168.1 |
| 5,800,677 | A | * | 9/1998 | Kato | 162/199 |
| 5,914,006 | A | * | 6/1999 | Nellessen et al. | 162/158 |
| 5,952,394 | A | * | 9/1999 | Nguyen | 514/772.2 |

FOREIGN PATENT DOCUMENTS

SU 1036085 * 10/1965

* cited by examiner

*Primary Examiner*—Dean T. Nguyen
(74) *Attorney, Agent, or Firm*—Bruce F. Jacobs

(57) ABSTRACT

A process for controlling/reducing the deposition of stickies from paper stock suspensions in papermaking involving the steps of: (a) providing a paper stock suspension containing stickies; and (b) contacting the stickies in the paper stock suspension with a copolymer of about 75–95 wt % acrylamide and about 5–25 wt % vinyl acetate.

20 Claims, No Drawings

USE OF ACRYLAMIDE COPOLYMER TO REDUCE STICKIES DEPOSITS

This application claims benefit of Provisional Application No. 60/205,283 filed May 18, 2000.

BACKGROUND OF THE INVENTION

This invention relates to a process for controlling the deposition of sticky impurities from paper stock suspensions in paper manufacture.

Even when paper was invented in the second century, the use of waste material, i.e. the technique of at least partial recycling, played a certain role. Nowadays, considerable significance is attributed to recycling technology through increasing ecological awareness. In view of the increasing production of paper, therefore, the supply of raw materials and the avoidance of waste are acquiring increasing significance.

By using secondary fiber stock from the recycling of waste paper, savings can now be made in raw materials required, waste-disposal space, and the energy required for paper manufacture. Unfortunately, the technology still involves specific difficulties.

In the processing of waste paper, sticky impurities, normally known as "stickies," can seriously disrupt the production process and adversely affect the quality of the paper produced. Stickies enter the papermaking process when the waste paper used contains adhesive bonds, adhesive tapes or refined products, such as coated or laminated papers and paperboards. In addition sticky impurities can be formed by the resin in wood and through its interaction with paper auxiliaries.

The present invention is primarily directed to a problem associated with the secondary fiber industry. This problem is found in all stages of the industry, including the repulping stage, the paper or paper product formation stage, paper or paper product finishing stage, and the handling, storage, and usage stages. The secondary fiber industry utilizes waste paper or paper products as a source of paper fiber (commonly referred to as "secondary fiber") to produce finished paper products. Waste paper and paper products which are the source of the secondary fiber may include any waste paper product such as newspapers, books, magazines, waste bags and boxes, waste ledgers, files, waste cuttings or trimmings from pressure sensitive adhesive backed labels, decals, stickers (i.e., bumper), etc.

In the repulping of the secondary fibers, a problem is encountered due to the adhesives, ink and coating binders (primarily those composed of synthetic polymers) that are found on some of the waste paper being utilized. More specifically packaging tapes, labels, decals, stickers, stamps, envelopes, book bindings, etc., each have adhesives associated therewith. Thus when waste products are recycled, the adhesives give rise to the stickies problem. Stickies are the remainder of the adhesives, ink and coating binders which are not solubilized in the process water and cause many problems ranging from machine operating efficiency through to finished product quality.

Where the stickies are present in large enough form, they can be mechanically removed relatively easily by means of screening equipment. In general, however, the stickies are present not only as large pieces, but also as small dispersed particles in the pulp stock which are very difficult to remove. Recently, therefore, the increasing use of waste paper in paper manufacture and the restriction of the water circuits has increasingly resulted in larger quantities of stickies remaining in the pulp furnish and in the recirculated process water.

As indicated, the stickies cause a number of problems and disruptions not only in the paper-making process, but also in the processing of the product paper. On account of their stickiness, deposits are formed on machine parts, tube walls, screens, forming wires, wet felts, dry felts, drying cylinders, press rolls, calender rollers, and in addition, even on the paper itself, resulting in web tears in the papermaking machine and in a deterioration in paper quality through holes, stains and marks (cf. H. L. Baumgarten, Das Papier, 1984, 38, No. 10A, pages V121–V125). According to Baumgarten, stickies in industrial and institutional publications have for years been the biggest problem in the recycling of waste paper. Even minimum quantities of adhesive can cause tears in papermaking and printing machines, so that the machines have to be stopped for cleaning purposes. Baumgarten states: "2 g of adhesive at the right place in the papermaking machine can turn several hundred kg of paper into waste" (loc. cit., page V122, right-hand column).

Stickies have various origins. Essentially, they emanate from the residual wood resin in pulp, from auxiliaries involved in paper manufacture, from binders for the coating of paper and cardboard, from packaging tape and label adhesives, from printing ink binders and from materials involved in the processing of paper. Stickies emanating from the residual wood resin and from the adhesives found in recycled paper and paperboard are particularly important in the context of the problem addressed by the present invention. The resins present in chemical wood pulp and mechanical wood pulp contain around 1 to 5% by weight of so-called harmful resins, depending on the type of wood. These resins may be present in colloidal, unbound form or may adhere to the paper fibers.

The adhesives commonly associated with recycled paper and paperboard may be divided into three main groups, namely: contact adhesives, dispersion-based adhesives, and hot-melt adhesives. Contact adhesives are permanently tacky and permanently bondable products. Adhesion is achieved by application of pressure to the surfaces of the parts to be bonded. The basic polymers may be any of various key chemicals in combination with corresponding additives, for example tackifying resins, plasticizers or antioxidants. Typical basic polymers are inter alia natural rubber, butyl rubber, styrene/butadiene copolymers (SBR rubber), acrylonitrile copolymers, polychloroprene, polyisobutylene, polyvinyl ether, acrylates, polyesters, polyurethanes, and silicones.

Dispersion-based adhesives have the adhesive layer polymers in the form of solid particles in an aqueous dispersant. In the production process, the basic monomers are first emulsified in an aqueous phase and then polymerized therein—a technique known as emulsion polymerization. The polymer is then present in the form of small particles with varying particle sizes ranging from molecularly disperse to coarsely disperse. In general, agglomeration and hence sedimentation of the polymer particles is counteracted by adding protective colloids or emulsifiers to the system.

The so-called hot-melt adhesives, also known as "hotmelts," belong to the group of thermoplastics. These materials have the property of softening on heat-ing, so that they become fluid. On cooling, they solidify again. Examples of polymers used as hot-melt adhesives include polyamides, copolyamides, poly-aminoamines, saturated polyesters and ethylene/vinyl acetate copolymers.

The stickies generated during the recycling of waste paper often have undergone a change in their particle size brought about by thermal, chemical and mechanical influences. This means that even impurities which are still present in extremely coarse form at the beginning of recycling can undergo more or less considerable size reduction in the recycling process. In particular, stickies are dispersed by the processes taking place in the repulping and refining equipment used in the recycling of waste paper. For example, stickies with a low melting point can be liquefied and then very finely dispersed. Crumbly or fragile stickies also disintegrate into very small particles. The particle size of the dispersed stickies thus ranges from coarsely disperse through colloidally disperse to molecularly disperse.

In other words, many stickies are readily dispersible with the result that, after the repulping step, they are present in finely divided form and are not removed by the pulp screening equipment. These substances are in danger of forming agglomerates—also known as secondary stickies—in the papermaking machine under thermal, mechanical or chemical influences. It is precisely these secondary stickies which cause problems in the further processing of paper. For example, they are trans-ported by the paper webs, pass through the papermaking machine and thus arrive at the various places where they lead to unwanted deposits, more particularly at press rolls, press felts, dryer fabrics, drying cylinders, smoothing rollers. In addition, they are of course also present in the paper itself, thus adversely affecting its quality.

Accordingly, it is clear from the situation outlined in the foregoing that, basically, any parameters which promote the agglomeration of particles bring with them the danger of formation of secondary stickies. The pH value and certain papermaking auxiliaries are mentioned as two very important parameters in this regard. In particular, a neutral or acidic medium and use of cationic auxiliaries to improve drainage and retention are two conditions which promote the agglomeration of particles and the formation of stickies.

Now, there have been numerous attempts to deal with the problem of stickies in the manufacture of paper. In this connection, particular significance is attributed among experts to the approach whereby the deposition of stickies is suppressed by an auxiliary so that the problems caused by the adhesive properties are reduced to a technically acceptable level. Processes based on this approach are referred to hereinafter as SDC (stickies deposition control) processes.

For example, U.S. Pat. No. 4,923,566 describes a process in which stickies are controlled with urea. U.S. Pat. No. 3,081,219, controls stickies in the sulfite pulping of wood with the aid of N-vinyl-2-pyrrolidone.

Attempts have also been made to control stickies by the addition of bentonites, diatomaceous earth and the like. This well-known approach is based on the idea of introducing fine particles which are capable of binding sticky impurities at their surface (cf. U.S. Pat. No. 3,081,219, column 1, lines 40–44). Another approach is based on the addition of sequestering agents, for example polyphosphates (cf. U.S. Pat. No. 3,081,219, column 1, lines 45–50). Attempts have also been made to use various dispersants, for example the sodium salts of sulfonated formaldehyde/naphthalene condensates, although this leads to the disadvantage of unfavorable interactions with cationic auxiliaries (cf. U.S. Pat. No. 3,081,219, column 1, lines 51–58).

U.S. Pat. No. 4,744,865 describes an SDC process in which the coagulation of sticky impurities is said to be reduced by polymers containing methoxy groups.

U.S. Pat. No. 4,871,424 relates to an SDC process using polymers containing hydroxyl groups. However, the only polymers explicitly disclosed are cellulose derivatives, such as hydroxypropyl methyl cellulose, and polyvinyl alcohol which can be obtained by hydrolysis or partial hydrolysis from polyvinyl acetate.

Since none of the above procedures have adequately resolved the problem, substantial additional research is being conducted to develop a commercially successful resolution to the stickies problem. One recent example of this is U.S. Pat. No. 5,639,346 which seeks to prevent the build-up of stickies by attaching the stickies in a waste paper pulp to a magnetic carrier material with the help of an agglomeration agent, followed by magnetic separation.

Accordingly, there is a constant need for new and alternative solutions to the problem of controlling stickies in paper manufacture. The present invention is a result of continuing research of the problem which seeks to overcome the dis-advantages and inefficiencies of current procedures.

SUMMARY OF THE INVENTION

According to this invention, the adhesion and deposition of stickies can be drastically reduced by treatment with dilute aqueous solutions of a polyacrylamide copolymer. Since it is the property of contact adhesion that causes stickies to be so troublesome, the polyacrylamide copolymer is a useful treatment for controlling the tendency of such materials to deposit on paper making process equipment. The most desirable stage for addition of the polyacrylamide copolymer is at any location in which the copolymer will remain in intimate contact with the pulp furnish for at least 10 minutes prior to the pulp passing a point at which the stickies deposit.

More particularly, the deposition of sticky impurities (stickies) from paper stock suspensions in paper manufacture is reduced by adding an effective quantity of a water-soluble copolymer containing about 75–95 wt % acrylamide and about 5–25 wt % vinyl acetate to a paper stock suspension.

Still more particularly, the water-soluble copolymer has a viscosity in the range of about 250 to 10,000 cp as a 15% solids solution.

DESCRIPTION OF THE INVENTION

The present invention is generally applicable to all types of sticky impurities present in conventional paper pulps. In a preferred embodiment, it applies to paper pulps which contain substantial amounts of recycle paper or paperboard products. In a more preferred embodiment, it applies to paper pulps which contain contact adhesives, dispersion-based adhesives, and hot-melt adhesives.

There are several advantages associated with the present invention as compared to prior art processes. These advantages include: an ability to function without being affected by the hardness of the water used in the system unlike certain anionics; an ability to function with lower foaming than surfactants; and an ability to function while not adversely affecting sizing, fines retention, or pitch retention. The present invention both generates less foam and is less expensive than those processes which utilize hydrolyzed polyvinyl alcohol polymers.

The polyacrylamide-vinyl acetate copolymers useful in the present invention may be prepared by any copolymerization process known to the art. A particularly suitable process has been found to be solution polymerization in which the acrylamide and the vinyl acetate are copolymerized in a mixed solution of water and a non-flammable solvent for the vinyl acetate. Examples of suitable solvents include the lower glycols, e.g. ethylene glycol, propylene glycol, and butylene glycol, as well as dioxane, dimethylsulfoxide, dimethyl formamide, and the like.

Conventional acrylamide solution polymerization additives, catalysts, and operating conditions are generally used. Since these are well known, further detail is not provided here but may be found in the open literature.

Generally suitable copolymers will contain about 75 to 95 wt % acrylamide and about 5 to 25 wt % vinyl acetate. Preferred compositions are those containing about 80 to 92 wt % acrylamide and about 8 to 20 wt % vinyl acetate. Most preferred compositions contain about 85 to 90 wt % acrylamide and about 10 to 15 wt % vinyl acetate.

While vinyl acetate is the preferred comonomer, other hydrophobic monomers may also be used in similar amounts. Exemplary other hydrophobic monomers include methyl (meth)acrylate, methyl ethacrylate, octadecylacrylate, n-octadecyl-acrylamide, styrene, methyl styrene, allyl stearate, vinyl stearate, ethene, propene, n-butene, isobutene, pentene, dodecene, octa-decene, vinyl ethers higher than methyl, and acrylonitrile.

It is believed that effective copolymers of this invention have a random distribution of the vinyl acetate monomer along a predominantly acrylamide polymer chain, as well as various degrees of block formation and/or alternation within the polymer. By the term "block formation", it is meant that monomeric units of the same type tend to form regions in the copolymer to the exclusion of the other monomer or to a greater extent relative to the numbers of monomer molecules present. By the term "alternation", it is meant that the two monomers within the copolymer polymerize in such a manner that the vinyl acetate monomer is uniformly distributed along the acrylamide polymer chain.

Preferred copolymers for use in the present invention are those exhibiting viscosities in the range of about 250 to 10,000 cp as a 15% solids solution. Other molecular weight/viscosity copolymers may also be used.

The copolymers of the instant invention are effective in controlling stickies deposition in papermaking systems, such as Kraft, acid sulfite, groundwood, and especially in recycled fiber papermaking systems. For example, stickies deposition in the brown stock washer, screen room and decker systems in Kraft papermaking processes can be controlled. The term "papermaking system" is meant to include all pulp processes. Generally, it is thought that these copolymers can be utilized to prevent stickies deposition on all wetted surfaces from the pulp mill to the reel of the paper machine under a variety of pH's and conditions. More specifically, these copolymers effectively decrease the deposition of metal soap and other resinous pitch components not only on metal surfaces, but also on plastic and synthetic surfaces such as machine wires, forming fabrics, press felts, foils, uhle boxes, press roll covers, and headbox components. The copolymers of this invention may also be effective in preventing deposition of the ethylene bis-stearamide (EBS) components of many common defoamers. EBS frequently shows up as a major component of unwanted deposits from the pulp mill to the reel of the paper machine.

In principle, the copolymers according to the invention may be added at any point of the overall papermaking process. Although the copolymers can be added in dry particulate form or as a dilute aqueous solution, they are generally added in the form of an aqueous solution or dispersion. The particular effective quantity of the acrylamide-vinyl acetate copolymer required depends on the extent to which the waste papers or paper products containing waste paper constituents to be processed contain sticky impurities. The copolymers according to the invention are such effective detackifying agents that they can be used in very small amounts, i.e. generally between about 0.5 and 100 ppm of copolymer based upon the weight of the pulp slurry. Preferably, the copolymer is used at a rate of about 1 to 30 ppm. Most preferably, the copolymer is used at a rate of about 5 to 10 ppm.

In principle, the process according to the invention is suitable for controlling the deposition and adhesion of stickies of various kinds, i.e. differing in their chemical and physicochemical nature. However, the advantages of the process according to the invention are particularly applicable to stickies based on contact adhesives and hot-melt adhesives (hotmelts).

The following Examples are intended to illustrate the invention without limiting it in any way. All parts and percents are by weight unless otherwise specified.

EXAMPLE 1

A four-necked 1000 ml. round bottom flask was equipped with an overhead stirrer set at 400 rpm, a water-cooled condenser, a nitrogen sparge, a temperature probe connected to a temperature controller for a 1000 ml. heating mantle and a syringe pump. The flask was charged with 201.1 g 52.5% aqueous acrylamide solution (105.6 g acrylamide, 1.49 mole), 14.4 g vinyl acetate (0.18 mole), 112 g propylene glycol, 450 g deionized water and 0.33 g of a 20% aqueous solution of diethylenetriamine penta-acetic acid. The solution, which was clear and homogeneous, was sparged with nitrogen for 15 minutes. A solution of 0.51 g 45% aqueous sodium chlorate in 5.5 g deionized water was added. After mixing for 5–10 minutes, a solution of 4.43 g 40% aqueous sodium bisulfite in 6.1 g deionized water was added at a rate of approximately 6.8 ml/hour using the syringe pump. Within minutes an exotherm occurred and the temperature increased to 50–52° C. The temperature was increased to 60° C. and held for 3–4 hours.

The resulting product had a solids content of 19.3% and a Brookfield viscosity of 460 cp.

EXAMPLE 2

A test method was developed to determine the effect of additives on the tackiness of standard adhesive tape. The instrument used for the test method was a Model CS-163 ZDT (Z-direction tensile tester) manufactured by Custom Scientific Instruments, Inc. This instrument contains two platens that are forced together with a contact force of 191–192 lbs. for a 6 second dwell time during the compression stage of the test. The platens are then separated during the tension stage of the test. Normally, a paper sample sandwiched between two pieces of double sided adhesive tape is used in the test. The instrument measures the tensile force required to rupture the paper in the Z-direction.

The test was modified to evaluate the effects of additives on the tackiness of adhesive tape itself. The test specimen was prepared as follows: A 3–4 inch length of 2 inch wide Scotch 3M double-sided pressure-sensitive tape was adhered to the back side of 2 inch wide 3M Ultraclear brand pressure-sensitive packaging tape which was still on the roll. The release paper backing was left on the double-sided tape. Approximately 2½–3 inches of the composite tape was peeled off the roll and cut free with a scissors. The test sample was immersed in a beaker of the aqueous test solution for 15 minutes. The aqueous solution was stirred with a magnetic stirrer during this time.

A 3–4 inch piece of the 3M pressure-sensitive packaging tape was applied to the lower platen of the test instrument with the adhesive side against the platen. At the end of the 15 minute soak, the test specimen was removed from the aqueous solution. The release paper backing was removed from the specimen, and the specimen was set on the smooth backing of the packaging tape on the lower platen with the wetted adhesive side of the packaging tape in contact with the backing of the packaging tape. The test cycle was initiated, and the unwetted side of the double-sided tape contacted the upper platen during the compression stage of the test. As the platens were pulled apart, the instrument measured the force required to separate the wetted adhesive side of the packaging tape attached to the upper platen from the backing of the packaging tape attached to the lower platen.

Tests were carried out on three aqueous solutions: (1) water (control), (2) 7.5 ppm solution of the acrylamide-vinyl acetate copolymer composition of Example 1, and (3) 7.5 ppm of a hydrolyzed polyvinyl alcohol sample as disclosed in U.S. Patent 4,886,575. The average results of 9 test samples are summarized in Table 1.

TABLE 1

| Sample | Lbs Z-Direction Tensile Force |
|---|---|
| Control | 198.5 |
| Example 1 | 109.4 |
| Hydrolyzed Polyvinyl Alcohol (prior art) | 137.7 |

What is claimed is:

1. A method of inhibiting the deposition and adherency of adhesive materials on the surfaces of papermaking equipment during the manufacture of paper from a pulp furnish containing repulped waste paper or paperboard products having such adhesive materials which comprises adding to the pulp furnish about 0.5 to 100 ppm of a water-soluble copolymer of about 75–95 wt % acrylamide and about 5–25 wt % vinyl acetate.

2. The method according to claim 1, wherein the copolymer is used in an amount of about 1 to 30 ppm.

3. The method according to claim 1, wherein the copolymer comprises about 80–92 wt % acrylamide and about 8 to 20 wt % vinyl acetate.

4. The method according to claim 1, wherein the copolymer comprises about 85 to 90 wt % acrylamide and about 10–15 wt % vinyl acetate.

5. The method according to claim 1, wherein the copolymer has a viscosity of about 250 to 10,000 cp as a 15% solids solution.

6. The method according to claim 1, wherein the adhesive material is selected from the group consisting of styrene butadiene rubber, vinyl acrylate based adhesives, natural rubber adhesives, and polyisoprene adhesives.

7. The method according to claim 1, wherein the adhesive material is selected from the group consisting of contact adhesives, dispersion-based adhesives, and hot-melt adhesives.

8. A method of inhibiting the deposition and adherency of stickies contained in a pulp produced from waste paper or paper products on the surfaces of equipment, utilized to produce finished paper products from said pulp which consists essentially of adding to the pulp about 0.5 to about 100 ppm of a copolymer comprising about 75 to 95 wt % acrylamide and about 5 to 25 wt % vinyl acetate.

9. The method according to claim 8, wherein the copolymer is used in an amount of about 1 to 30 ppm.

10. The method according to claim 8, wherein the copolymer comprises about 80–92 wt % acrylamide and about 8 to 20 wt % vinyl acetate.

11. The method according to claim 8, wherein the copolymer comprises about 85 to 90 wt % acrylamide and about 10–15 wt % vinyl acetate.

12. The method according to claim 8, wherein the copolymer has a viscosity of about 250 to 10,000 cp as a 15% solids solution.

13. The method according to claim 8, wherein the stickies comprise an adhesive material selected from the group consisting of styrene butadiene rubber, vinyl acrylate based adhesives, natural rubber adhesives, and polyisoprene adhesives.

14. The method according to claim 8, wherein the stickies comprise adhesive materials selected from the group consisting of contact adhesives, dispersion-based adhesives, and hot-melt adhesives.

15. A method of preventing paper and paper products from adhering to the surfaces of paper production equipment and to other paper and paper products when said products are produced from a pulp derived at least in part from waste paper or paper products containing hot melt or pressure sensitive adhesive materials, which comprises incorporating into the pulp used to form said paper or paper product about 0.5 to about 100 ppm of a copolymer consisting essentially of moieties of acrylamide, which polymer further contains hydrophobic groupings and is water-soluble.

16. The method according to claim 15, wherein the copolymer is used in an amount of about 1 to 30 ppm.

17. The method according to claim 15, wherein the copolymer comprises about 80–92 wt % acrylamide.

18. The method according to claim 15, wherein the hydrophobic group-ings are derived from monomers selected from the group consisting of vinyl acetate, methyl (meth)acrylate, methyl ethacrylate, octadecyl-acrylate, n-octadecyl-acrylamide, styrene, methyl styrene, allyl stearate, vinyl stearate, ethene, propene, n-butene, isobutene, pentene, dodecene, octadecene, vinyl ethers higher than methyl, and acrylonitrile.

19. The method according to claim 15, wherein the copolymer comprises about 85 to 90 wt % acrylamide and about 10–15 wt % vinyl acetate.

20. The method according to claim 15, wherein the copolymer has a viscosity of about 250 to 10,000 cp as a 15% solids solution.

* * * * *